US005103505A

United States Patent [19]

Llorens

[11] Patent Number: 5,103,505

[45] Date of Patent: Apr. 14, 1992

[54] COMFORT PANTS

[76] Inventor: Margaret A. Llorens, 1414 Joliet Pl., Detroit, Mich. 48207

[21] Appl. No.: 698,120

[22] Filed: May 10, 1991

[51] Int. Cl.[5] ..... A41B 9/00

[52] U.S. Cl. ..... 2/400; 2/401; 2/402; 2/403; 2/228; 2/267; 450/102; 450/103; 450/104; 450/98

[58] Field of Search ..... 2/400, 401, 402, 403, 2/228, 267; 450/102, 103, 104, 98

[56] References Cited

U.S. PATENT DOCUMENTS 4,805,243 2/1989 Gibbens et al. ..... 2/228
4,894,867 1/1990 Cervolo et al. ..... 2/228
4,945,571 8/1990 Calvert ..... 2/228
4,961,233 10/1990 Black ..... 2/228
4,969,216 11/1990 Guelli ..... 2/400
4,984,304 1/1991 Brown ..... 2/400
5,034,998 7/1991 Kolsky ..... 2/267

*Primary Examiner*—Werner H. Schroeder
*Assistant Examiner*—Gloria Hale
*Attorney, Agent, or Firm*—Krass & Young

[57] ABSTRACT

Comfort pants having cushioned buttocks portions. The pants comprise a pair of boxer-like shorts having a rear, reinforced panel including a pair of pads which are disposed on either side of a center line of the rear panel at locations thereon corresponding to those portions of a wearer's buttocks which come into contact when the wearer is seated on a flat surface.

12 Claims, 2 Drawing Sheets

COMFORT PANTS

FIELD OF THE INVENTION

This invention relates generally to the field of garments designed to cover the lower torso and, more particularly, to such a garment which cushions the buttocks area of a wearer when seated on a flat surface.

DESCRIPTION OF THE RELEVANT PRIOR ART

Most people find it uncomfortable to sit on hard, flat surfaces for long periods of time. Such conditions are encountered in sitting on folding chairs, stadium bleachers, church pews, etc. This is a particular problem for residents of nursing homes who frequently have to sit on flat surfaces for a long period of time without shifting positions.

Typically, to avoid the discomfort caused by the hip bone pressing down on the buttocks area, people resort to sitting on cushions, pads and various inflated devices which help to cushion the buttocks area and render bearable long periods of sitting on hard, flat surfaces. However, cushions and such like have the obvious disadvantages that they must be separately carried along with the user and may be lost, stolen or left behind.

It is known to add padding to various portions of garments in order to cushion various body parts when the users are engaged in athletic or sporting activities. For example, U.S. Pat. No. 3,909,847 to Holt et al discloses a female pelvis and crotch protector particularly designed to absorb and render harmless shocks encountered in karate, judo, gymnastics, basketball and similar sports. The protector includes an hourglass-shaped composite pad of shock absorbent and protective material which is held in position to protect a female's pelvis and crotch region from said shocks. The patented device further discloses a pair of shock absorbent hip pads and a spine pad. The hip pads are positioned to protect the female's hips, and the spine pad is shaped and positioned to protect the base of the spine. However, the patented protector is neither designed for nor suitable for cushioning those areas of the buttocks which come into contact with flat surfaces when the wearer is seated thereon.

U.S. Pat. No. 4,805,243 discloses a padded pant construction for athletic purposes which includes rear and frontal pockets within which are retained resilient pads which cushion the muscle and tissue of the anatomy subjacent the pelvis. In particular, the garment is designed to be worn by cyclists and the padding is confined to the crotch and ischial areas of the garment without hindering leg motion or causing bulkiness of the attire. To that end, the front pad is confined to the pubic area, and the pair of rear pads cushion the ischia of the pelvis. Again, this garment is neither designed for nor adapted for sitting on a flat surface, where different parts of the anatomy come into contact with the seating surface than is the case in cycling.

It would be desirable to provide a garment designed to be worn on the lower torso which is particularly suitable for cushioning the buttock regions of a wearer which come into contact with a flat surface, when the wearer is seated thereon. It would be particularly desirable to provide such a garment which is both comfortable to wear, unrestrictive of other activities, and of minimal bulkiness when worn under other garments.

SUMMARY OF THE INVENTION

Disclosed and claimed herein is a garment designed to overcome the shortcomings of the prior art noted above. The claimed invention is a garment in the form of a pair of boxer-like shorts or pants of the type having two side panels joined to a waistband and to each other along a front seam. A reinforced rear panel is joined to side edges of the side panels along side seams thereof and to bottom edges of the side panels to form a crotch region. The reinforced rear panel further includes a pair of pads which are positioned along either side of center line of the rear panel at locations thereon corresponding to those regions of the buttocks of the wearer which come in contact with a hard surface when the wearer is seated thereupon.

The comfort pants of the present invention may be designed as either inner or outer garments. If designed as an inner garment, the garment is constructed to minimize bulkiness. To that end, the pair of pads may be constructed in the form of pouches which contain a relatively thin layer of a gel substance such as silicone gel. The silicone gel pouches will effectively cushion the buttocks of the user without adding undue weight or bulkiness.

In some cases, the comfort pants of the present invention may be designed as outer wear. For example, they can be designed as "stadium pants," suitable for wearing to sporting and athletic events. In this embodiment of the present invention, it may be desirable to exaggerate the appearance of the pads, rather than minimizing them. The pads may be sewn externally onto the rear panel of the garment and may be covered in a contrasting color fabric. For example, the colors of the pants and the contrasting pad could be selected to be the team colors of the home team, thus creating a garment which is both practical, comfortable and expressive of team loyalties.

Typically, the reinforced rear panel of the comfort pants of the present invention will further include at least one layer of quilting which is coextensive with the rear panel and disposed interiorally thereof, and an interior layer also coextensive with the rear panel and disposed interiorally of the quilted layer. In other words, the quilting is sewn or otherwise fastened between the rear panel and the interior panel.

In addition to the gel embodiment disclosed above, the pads may be formed of any resilient material, such as a resilient foam material, and may be disposed between the quilted layer and the interior layer.

BRIEF DESCRIPTION OF THE DRAWINGS

The following detailed description may best be understood by reference to the following drawings in which.

DETAILED DESCRIPTION OF THE PREFERRED EMBODIMENTS

Figure 1:
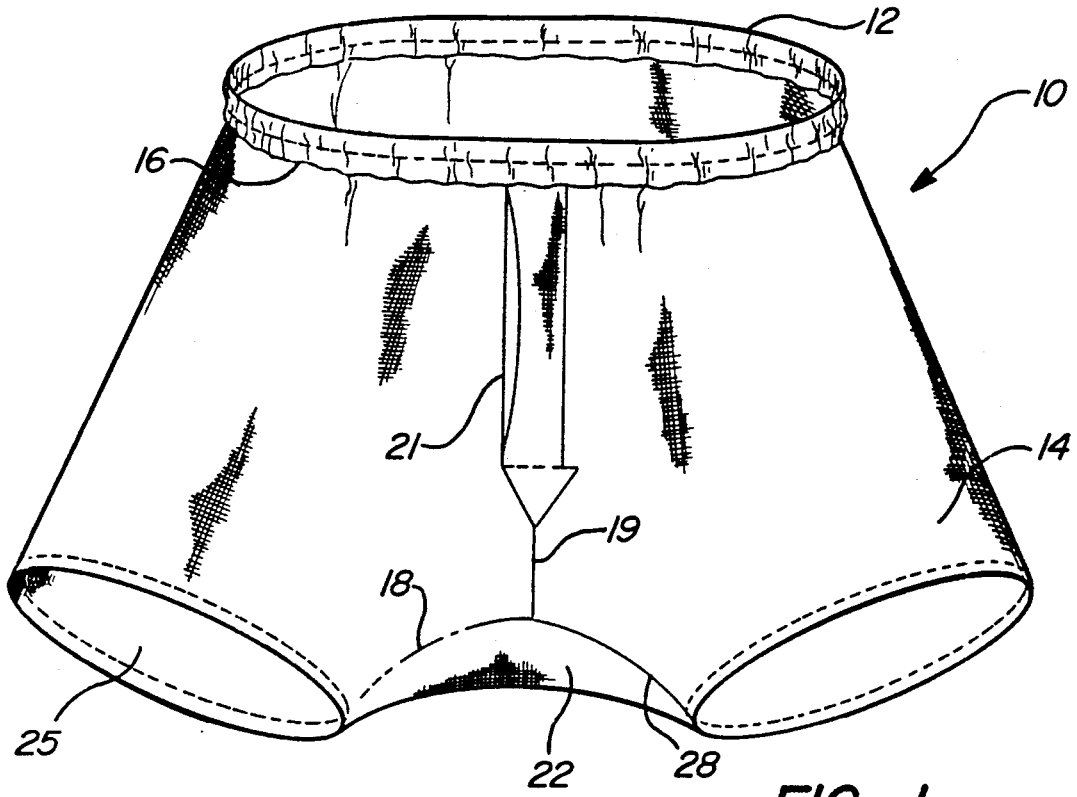
FIG. 1 is a front view of the comfort garment of the present invention.

Throughout the following detailed description, like reference numerals are used to reference the same element of the invention shown in multiple figures thereof. Referring now to the drawings and to FIGS. 1 and 2 in particular, there is shown a pair of comfort pants 10 constructed according to the teachings of the present invention. The comfort pants 10 are in the form of a pair of boxer-like shorts including a waistband 12 and a pair of side panels 14. Each side panel 14 has a top edge 16, a bottom edge 18, a front edge 19 and a rear edge 20. The top edge 16 of each side panel 14 is attached to waistband 12 and the front edges 19 of side panels 14 are joined at the front to form a front seam optionally having a fly opening 21 formed therein.

Figure 2:
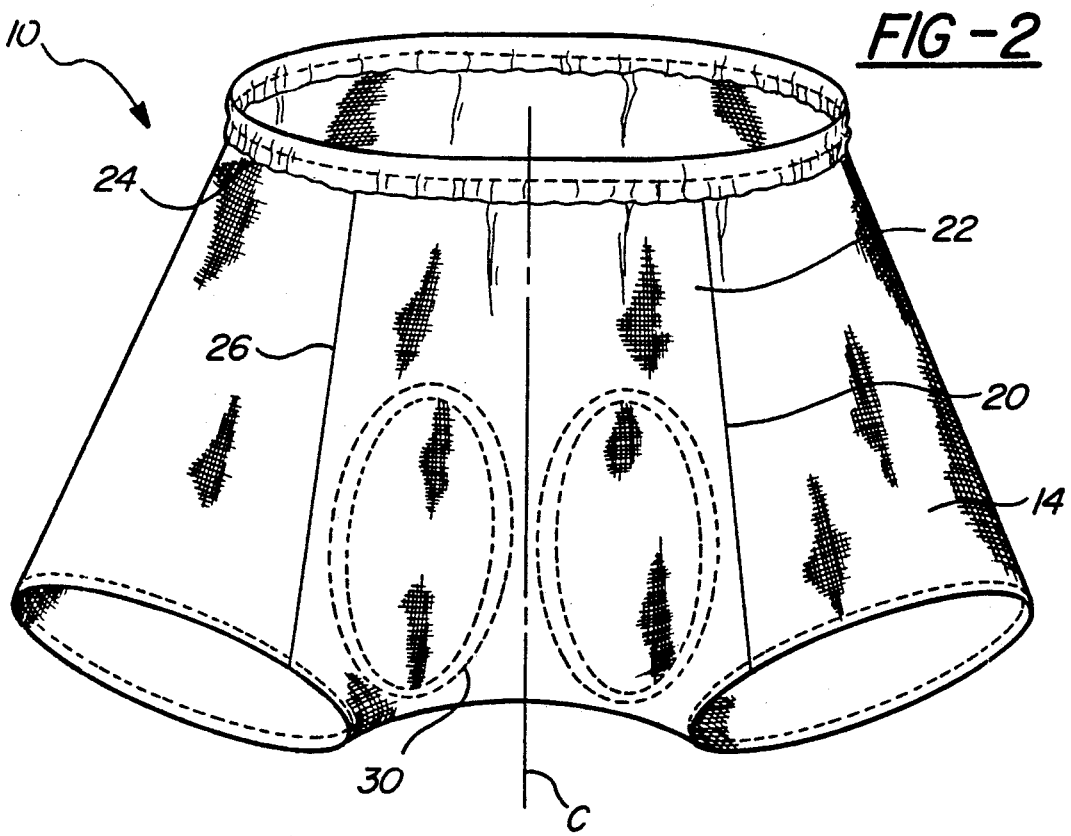
FIG. 2 is a rear view of the comfort pants shown in FIG. 1, with the pads thereof shown attached to the outside of the garment.

As can be seen clearly in FIG. 2, side panels 14 extend around to the rear of the garment to meet rear panel 22. Rear panel 22 includes top edge 24, side edges 26 and, as can be seen in FIG. 1, crotch edge 28. Rear panel 22 is positioned between side panels 14. Its top edge 24 is attached to waistband 12 and its crotch edge 28 is attached to the bottom edges 18 of side panels 14 to form a crotch area. The side edges 26 of rear panel 22 are attached to the side edges 20 of both side panels 14 to form a garment which encircles the lower torso of the wearer. The side and rear panels 14,22 are configured such that, when joined in the manner described, two leg openings 25 are formed to accommodate the legs of the wearer.

Figure 3:
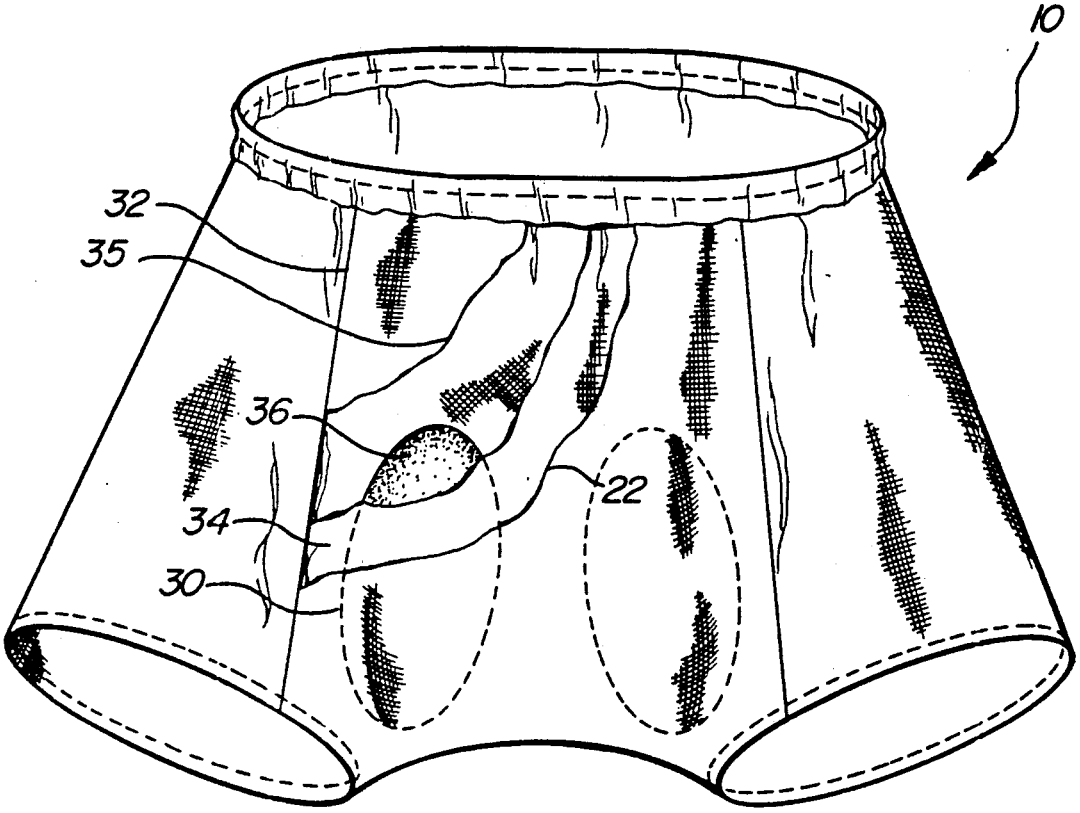
FIG. 3 is a rear view of an alternative embodiment of the comfort pants of the present invention showing the pads thereof disposed interiorally of the garment, with portions of the layers cut away to show in detail the rear construction of the garment.

Rear panel 22 is reinforced with layers 34, 35 of reinforcing material, such as quilting or cotton batten, as is most clearly depicted in FIG. 3 where the various layers of the rear panel 22 have been partially removed to show in detail the construction thereof. However, it is to be understood that rear panel 22 may itself be comprised of a reinforcing material, and may not require an additional reinforcing layer or layers 34,35 such as is shown in FIG. 3.

A pair of pads 30 are disposed on either line of a center line C drawn vertically through rear panel 22 and shown in FIG. 2. Each pad 30 is positioned such that it cushions those portions of the wearer's buttocks which come into contact with a flat surface when the wearer of the comfort pants is seated thereon. In one embodiment of the garment of the present invention, each pad 30 is formed of a resilient material such as a resilient foam. In the embodiment depicted in FIG. 2, the pads 30 are disposed on the exterior surface of rear panel 22 so that they are visible when worn. This embodiment is the "stadium pants embodiment," and the pads may be covered with a contrasting color material as previously described. Alternatively, the pads 30 may be disposed on the interior surface of rear panel 22, in which case they will not be visible when the garment is worn.

An alternative embodiment of the comfort pants of the present invention is shown in FIG. 3 which further comprises an interior panel 32 coextensive with the rear panel 22 and reinforcing layers 34,35. In this embodiment, which is designed to be worn underneath the outer garments, the pads 30 are disposed between reinforcing layers 34,35. Alternatively, the pads 30 could be disposed between reinforcing layer 34 and rear panel 22, or between internal panel 32 and rear panel 22.

In the embodiments of the present invention designed to be worn underneath outer garments, it is important that the pads 30 be made as thin and unobtrusive as possible. To this end, instead of being constructed of a resilient, foam material, the pads 30 may comprise pouches 36 filled with a gel-like substance such as a silicone gel. Due to the cushioning properties of the gel, the pads 30 may be constructed without excess bulkiness. This design improves the appearance of the wearer when the garment is worn underneath conventional outer garments.

The comfort pants of the present invention have been described with reference to certain embodiments and exemplifications thereof. Doubtless, other designs and variations could occur to one skilled in the art by utilizing the teachings of the present invention. For example, although depicted as shorts, the comfort pants of the present invention may extend to the knees or even to the ankles. They may have other elements such as pockets, etc. Such design variations are considered to be within the scope of the adept and are not a departure from the scope of the present invention as defined in the following claims.

I claim:

1. A pair of comfort pants comprising:

a waistband;

a pair of side panels each having an upper edge, a lower edge, a front side edge and a rear side edge, said panels being connected to each other along the front side edges thereof to form a front seam and to the waistband along the upper edges thereof;

a reinforced rear panel having an upper edge, a lower edge, and two side edges, said upper edge being connected to said waistband, said lower edge being joined together with the lower edges of the front panel to form a crotch area, and said side edges being joined together with the rear side edges o the front panels to define two leg openings; and a pair of seat pads disposed along both sides of a center line of said rear panel at locations thereon corresponding to those portions of the buttocks of a user which come into contact with a flat surface when the wearer is seated thereon.

2. The pants of claim 1 wherein he reinforced rear panel further comprises at least one layer of quilting disposed interiorally thereof.

3. The pants of claim 2 wherein the pads are formed of a resilient, form material.

4. The pants of claim 3 further comprising an interior panel coextensive with said rear panel and disposed interiorally of said quilting layer to there enclose.

5. The pants of claim 4 wherein said pads are disposed between said quilting layer and said interior panel.

6. The pants of claim 4 wherein said pads are disposed between said quilting layer and said rear panel.

7. The pants of claim 4 further comprising a second layer of quilting.

8. The pants of claim 7 wherein the pads are disposed between the quilting layers.

9. The pants of claim 1 wherein each of said pads is formed of a gel-filled sac.

10. The pants of claim 9 wherein the gel comprises silicone gel.

11. The pants of claim 1 further comprising a fly opening formed in the front seal thereof.

12. A pair of boxer-like shorts having a waistband, a pair of side panels joined to said waistband and to each other along a front seam, said side panels extending around a leg of a warer to enclose a portion thereof, and a rear panel joined to said side panels along rear seams and along a bottom seam to form a crotch portion thereof, said shorts further comprising:

a reinforcing layer coextensive with said rear panel and disposed interiorally thereof;

an internal panel coextensive with said rear panel and said reinforcing layer and disposed interiorally of said reinforcing layer; and a pair of pads disposed proximate said reinforcing layer and proximate locations on said rear panel on each side of a center line thereof, said locations corresponding to those portions of the buttocks of said user which come into contact with a flat surface when the wearer is seated thereon.

* * * * *